US008684892B1

(12) United States Patent
Ihli et al.

(10) Patent No.: US 8,684,892 B1
(45) Date of Patent: Apr. 1, 2014

(54) JUMP ROPES AND METHOD OF ASSEMBLING JUMP ROPES

(76) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 313 days.

(21) Appl. No.: 12/932,846

(22) Filed: Mar. 8, 2011

(51) Int. Cl.
*A63B 5/20* (2006.01)
*A63B 5/22* (2006.01)

(52) U.S. Cl.
USPC ..... 482/82; 482/81

(58) Field of Classification Search
USPC ..... 482/81, 82; 446/247, 307
See application file for complete search history.

(56) References Cited

U.S. PATENT DOCUMENTS

| | | | | | |
|---|---|---|---|---|---|
| 3,017,678 | A | * | 1/1962 | Christensen | 24/134 R |
| 3,107,092 | A | * | 10/1963 | Morris et al. | 482/82 |
| 4,101,123 | A | * | 7/1978 | Anthony | 482/82 |
| 4,605,219 | A | * | 8/1986 | Mahana et al. | 482/82 |
| 4,776,585 | A | * | 10/1988 | Maleyko et al. | 482/82 |
| 4,801,137 | A | * | 1/1989 | Douglass | 482/82 |
| 4,872,666 | A | * | 10/1989 | Smith | 482/82 |
| 4,878,270 | A | * | 11/1989 | Westerkamp | 24/132 R |
| 5,054,772 | A | * | 10/1991 | Winston | 482/82 |
| 5,102,381 | A | * | 4/1992 | Danielak et al. | 482/82 |
| 5,496,204 | A | * | 3/1996 | Brown et al. | 446/236 |
| 5,697,871 | A | * | 12/1997 | Landfair | 482/82 |
| 6,113,520 | A | * | 9/2000 | Greiner | 482/82 |
| 6,131,969 | A | * | 10/2000 | Natkins | 292/323 |
| 6,505,384 | B1 | * | 1/2003 | Renton et al. | 24/134 R |
| 6,595,900 | B1 | * | 7/2003 | Cook | 482/82 |
| 6,752,746 | B1 | * | 6/2004 | Winkler et al. | 482/82 |
| 7,293,438 | B2 | * | 11/2007 | Benda | 70/18 |
| 7,614,179 | B2 | * | 11/2009 | Kavanaugh | 43/44.91 |
| 8,043,196 | B1 | * | 10/2011 | Chen | 482/82 |
| 8,075,455 | B2 | * | 12/2011 | Gamboa et al. | 482/82 |
| 8,141,212 | B2 | * | 3/2012 | Fontaine et al. | 24/130 |
| 2005/0054483 | A1 | * | 3/2005 | Peng et al. | 482/4 |
| 2006/0128531 | A1 | * | 6/2006 | Planke | 482/39 |
| 2011/0207586 | A1 | * | 8/2011 | Whyatt et al. | 482/139 |

* cited by examiner

*Primary Examiner* — Oren Ginsberg
*Assistant Examiner* — Shila Jalalzadeh Abyane

(57) ABSTRACT

A jump rope has a flexible rope interconnected between left and right handles. Each handle includes two elongate half-pipe members that are held together by a sleeved collar at one end and a sleeved end cap at the other end. On each handle, a rope holder includes a rotor portion rotatably retained within the handle, and a clamping portion configured to releasably clamp a cross-section of the rope. Tubular elastomeric hand grips are preferably sleeved onto intermediate portions of respective handles.

17 Claims, 13 Drawing Sheets

JUMP ROPES AND METHOD OF ASSEMBLING JUMP ROPES

FIELD OF THE INVENTION

The present invention relates to jump ropes and methods of assembling jump ropes.

BACKGROUND OF THE INVENTION

Past efforts have led to various inventions directed toward jump ropes, yet room for continued improvement remains. An object of the present invention is to provide an improved jump rope handle. Another object of the invention is to provide an improved method of assembling a jump rope. Yet another object of the invention is to provide an improved method of adjusting the length of a jump rope.

SUMMARY OF THE INVENTION

The present invention involves jump ropes, jump rope handles, and methods of assembling, adjusting, and/or repairing jump ropes. A preferred embodiment of the present invention includes a pair of novel jump rope handles with a conventional flexible rope interconnected therebetween. Each handle includes a tubular body having an exterior sized and configured for grasping in a person's hand, and an interior sized and configured to house an end of the rope; and a rope clamp having a rotor portion rotatably retained within the interior of the tubular body, and a clamping portion disposed outside the tubular body, wherein the clamping portion is sized and configured to releasably clamp a section of the rope. Each tubular body preferably includes two elongate members having generally C-shaped cross-sections and aligned with one another to define a generally cylindrical tube, and a collar sleeved about one end of the tube, and an end cap sleeved about an opposite end of the tube.

The handle parts are configured to be assembled and disassembled without the use of any tools or secondary fasteners. As a result, assembly is quick and convenient, and after assembly and use, any broken part may be readily removed and replaced. The tubular nature of the handles cooperates with the releasable rope clamps to accommodate tidy and convenient adjustments to the length of available rope extending between the handles. In other words, the distal ends of the rope may be stored within the handle and selectively extracted if and when relatively more rope is needed (e.g. as a child grows). Conversely, relatively more of the rope may be stored if and when less rope is needed (e.g. when the jump rope is exchanged from a taller person to a shorter person). Many such features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the views.

DETAILED DESCRIPTION OF A PREFERRED EMBODIMENT

Figure 1:
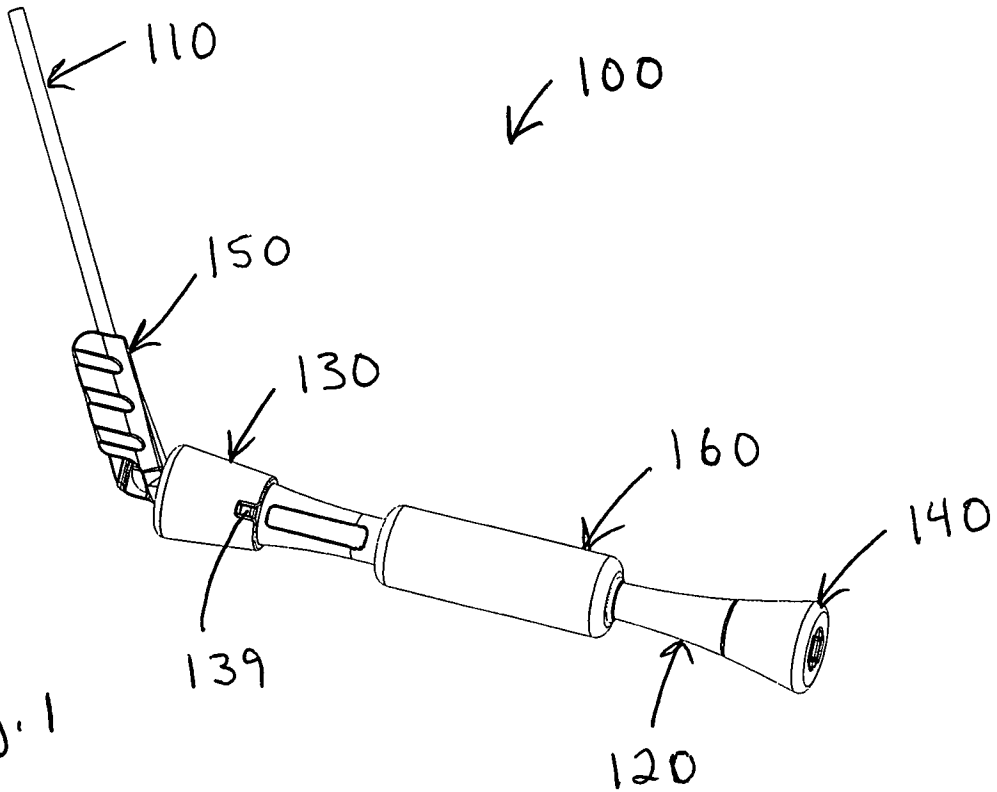
FIG. 1 is a perspective view of a preferred embodiment jump rope constructed according to the principles of the present invention.

FIGS. 1-6 show all the parts of a preferred embodiment jump rope 100 constructed according to the principles of the present invention. Generally speaking, the preferred embodiment jump rope 100 includes a length of conventional, flexible rope 110 that is made of extruded plastic, and left and right handles connected to respective ends of the rope 110. One of the handles is shown with the understanding that the other handle is identical thereto.

Each handle includes identical first and second tube halves 121 and 122 that cooperate to form a handle tube 120; a collar 130; an end cap 140; and a resilient hand grip sleeve 160. Also, as further explained below, a separate rope clamp 150 is rotatably retained within each handle tube 120 and releasably clamped to a respective end of the rope 110. Each handle tube 120 may be described as generally cylindrical in shape and approximately nine inches long, or alternatively, between seven and eleven inches long. Generally cylindrical may be interpreted to include varying outside diameters, in this case ranging between one-half inch and one and one-quarter inch, and various cross-sections that fall within a circle having a diameter up to one and one-quarter inches.

Figure 7:
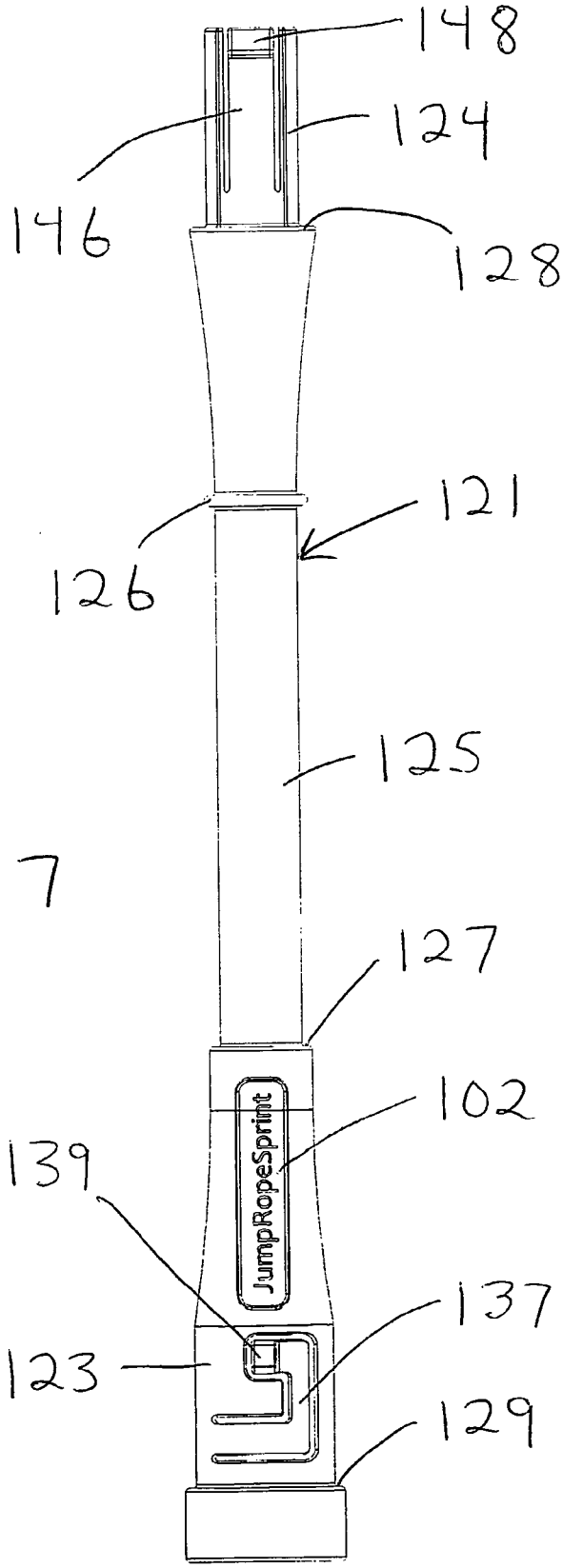
FIG. 7 is a side view of a handle member on the jump rope of FIG. 1.
Figure 8:
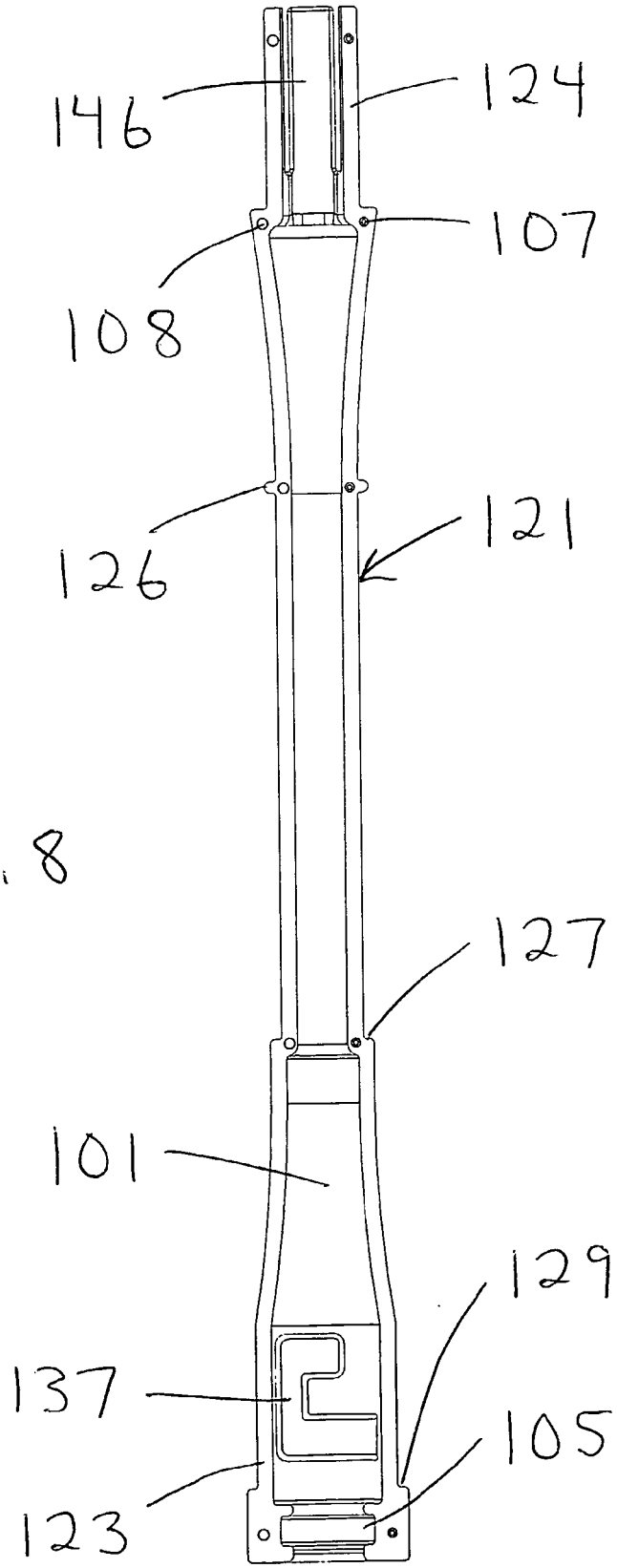
FIG. 8 is an opposite side view of the handle member of FIG. 7.

One of the tube halves 121 is shown by itself in FIGS. 7-8. Each tube half 121 and 122 is preferably injection molded plastic, and may be described as a half-pipe or as an elongate member having a generally semi-circular cross-section. Each tube half 121 and 122 extends from a first end 123 to a second end 124, and has an intermediate section 125 defined between stops or shoulders 126 and 127. Additional stops or shoulders 128 and 129 are defined on each tube half 121 and 122 to engage the end cap 140 and the collar 130, respectively. A logo area 102 for a trademark (e.g. JumpRopeSprint) is preferably provided on the exterior of each tube half 121 and 122 between the first end 123 and the shoulder 127.

A J-shaped leaf spring 137 is integrally formed in the first end 123 of each tube half 121 and 122, and it occupies the same arcuately curved space as the sidewall disposed about it. As shown in FIG. 7, a tab or nub 139 protrudes outward from the distal end of the leaf spring 137 and beyond the circumference defined by the surrounding material. For reasons discussed below, the leaf spring 137 resiliently flexes to accommodate inward movement of the tab 139 into the circumference defined by the surrounding material.

A linear leaf spring 146 is integrally formed in the second end 124 of each tube half 121 and 122, and it occupies a flat space that extends linearly in chord-like fashion relative to the adjacent material. As shown in FIG. 7, a tab or nub 148 protrudes outward from the distal end of the leaf spring 146 and beyond the circumference defined by the adjacent material. For reasons discussed below, the leaf spring 146 resiliently flexes to accommodate inward movement of the tab 148.

As shown in FIG. 8, each tube half 121 and 122 defines a substantially hollow and uninterrupted interior space 101 that is generally cylindrical and that extends the length of the handle 120. Also, cavities 105 in aligned tube halves 121 and 122 cooperate to define a cylindrical space in the handle tube 120 for reasons discussed in greater detail below. Mating pegs 107 and holes 108 are provided in the opposing edge walls of the tube halves 121 and 122 to help align the two identical parts 121 and 122 with one another (when one is flipped one hundred eighty degrees relative to the other).

The hand grip sleeve 160 may be described as a cylindrical tube made of foam rubber and known in the art. The sleeve 160 has an outside diameter of approximately one-inch, and an inside diameter that is slightly smaller than the outside diameter of the intermediate portion 125 of the handle tubes 120. Also, the hand grip sleeve 160 is sufficiently resilient to be pulled onto and beyond the second end 124 of the handle tube 120 and into a snug-fitting position on the intermediate portion 125.

Figure 6:
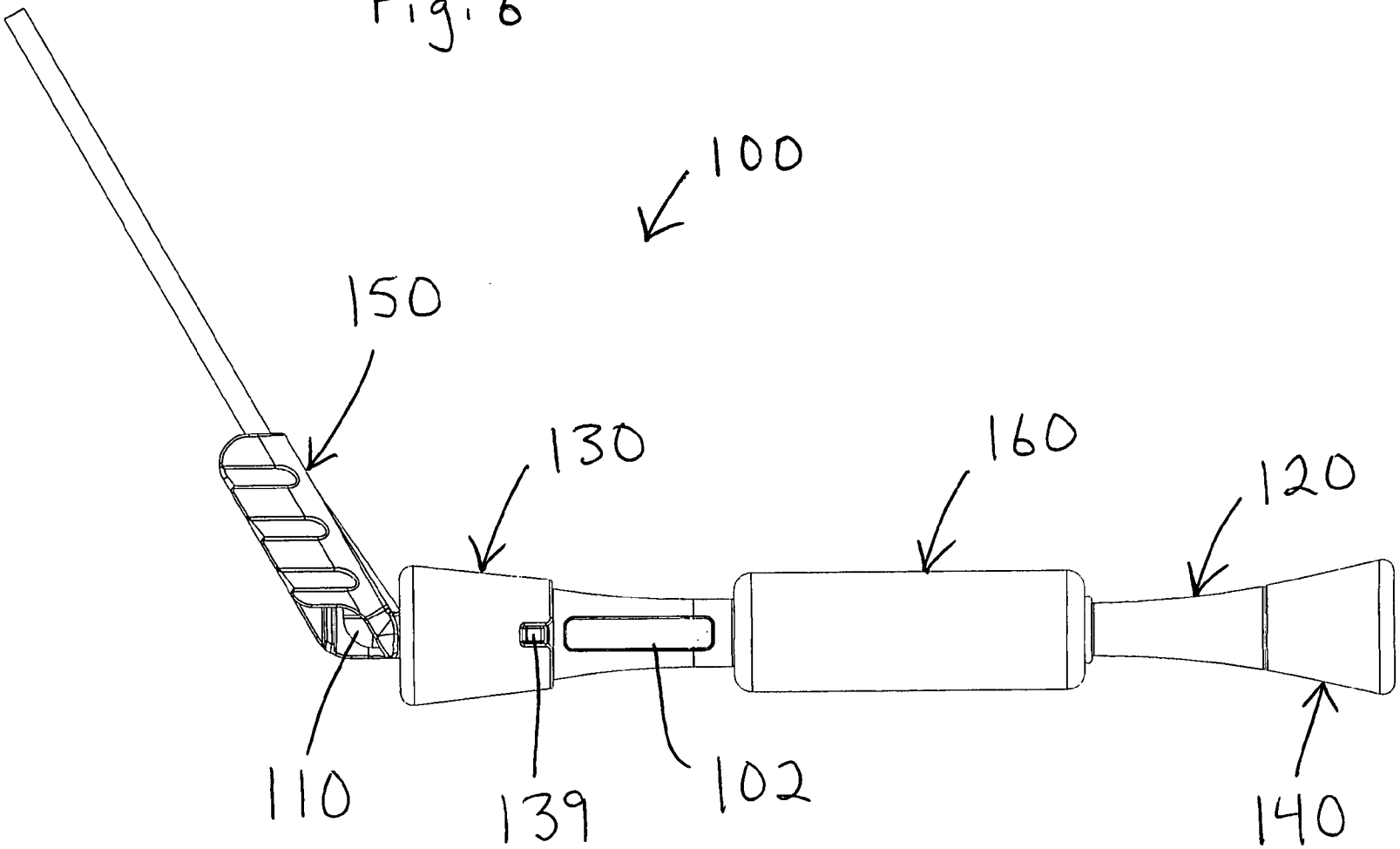
FIG. 6 is a side view of the jump rope of FIG. 1, the opposite side view being identical except for the orientation of the text.
Figure 9:
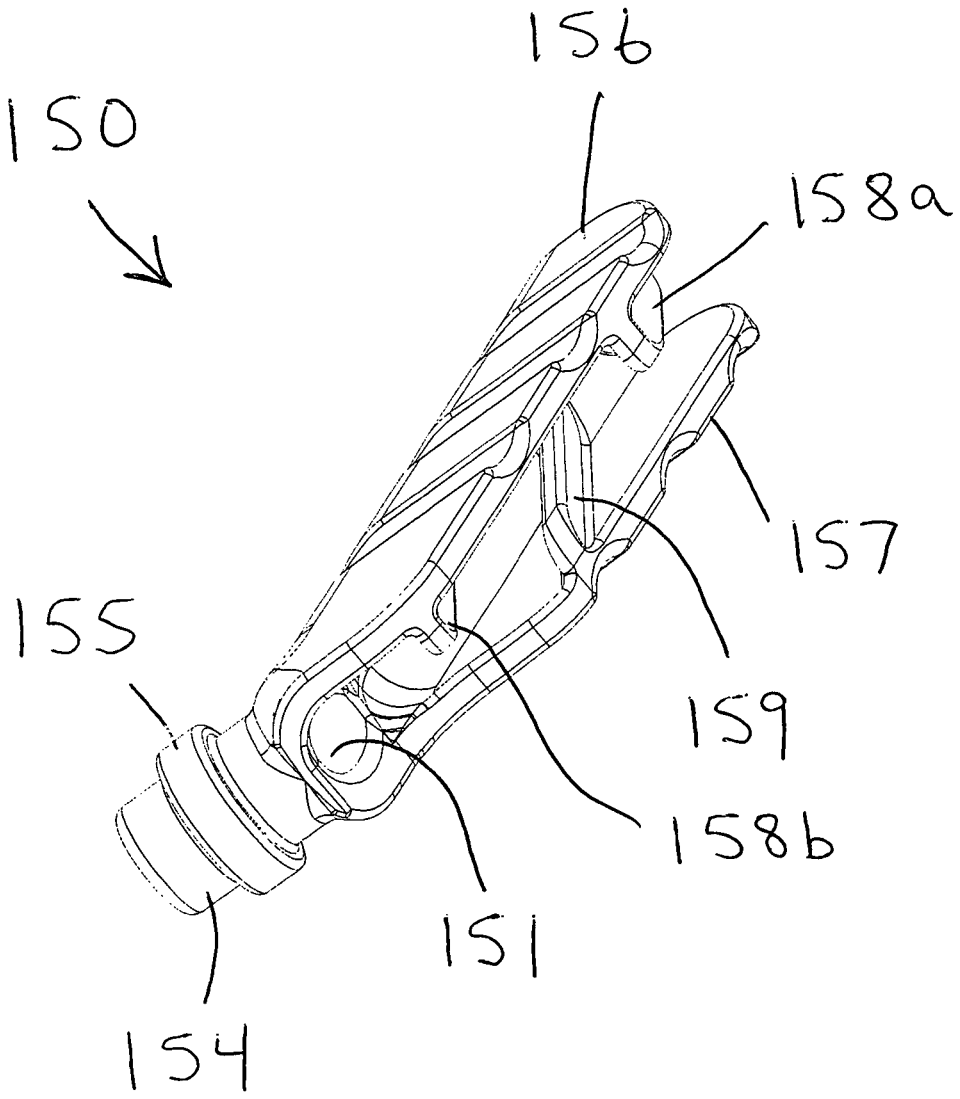
FIG. 9 is a perspective view of a rope clamp on the jump rope of FIG. 1.

FIG. 9 shows one of the rope clamps 150 by itself. Each rope clamp 150 is preferably injection molded plastic, and may be described in terms of a rotor portion and a clamping portion. The rotor portion includes a cylindrical disc 155 that is coaxially aligned with a shaft 154, and projects radially outward from the shaft 154. The disc 155 is sized and configured to rotatably fit within the two opposing, semi-cylindrical cavities 105 defined in the handle tube 120. A cylindrical bore 151 extends coaxially through the shaft 154 to accommodate insertion of one end of the rope 110, as further explained below. As shown in FIG. 6, the clamping portion is notched proximate the outer end of the bore 151 to provide access to the rope 110.

Figure 2:
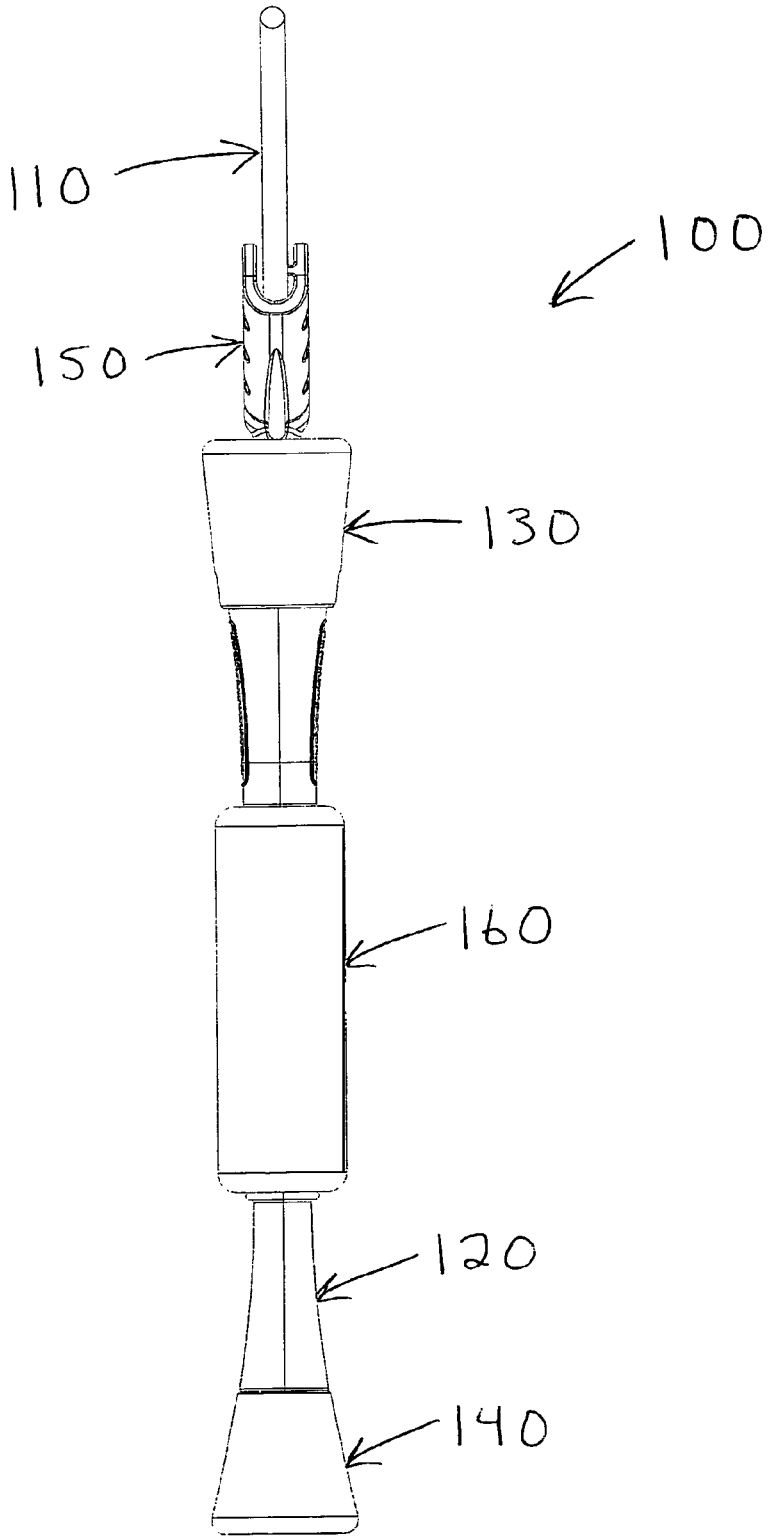
FIG. 2 is a top view of the jump rope of FIG. 1.
Figure 3:
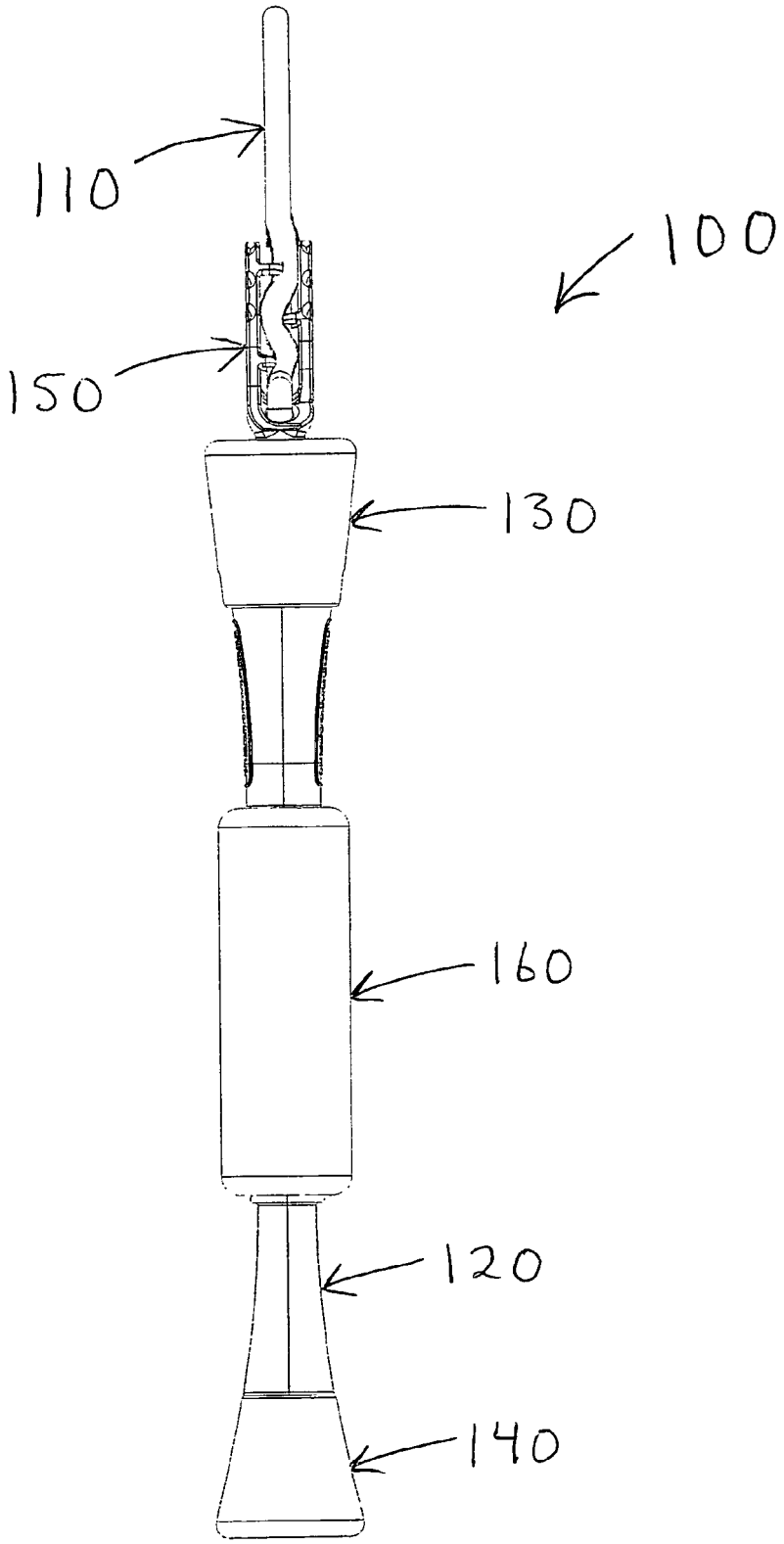
FIG. 3 is a bottom view of the jump rope of FIG. 1.
Figure 4:
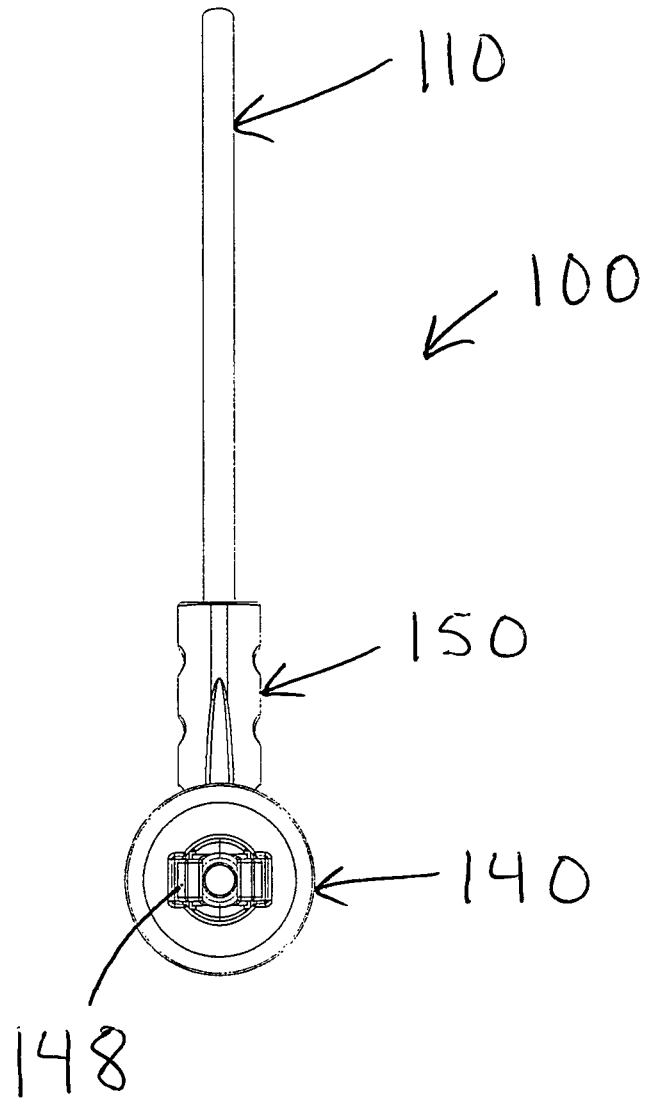
FIG. 4 is an end view of the jump rope of FIG. 1.
Figure 5:
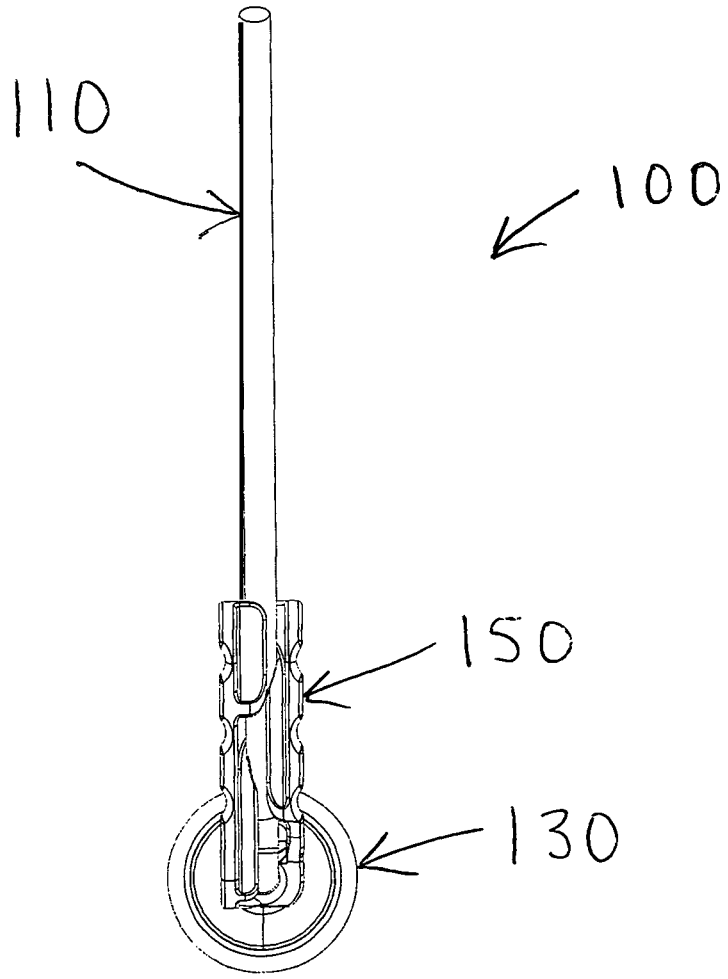
FIG. 5 is an opposite end view of the jump rope of FIG. 1.

The clamping portion has a generally U-shaped cross-section, and may be described in terms of opposing first and second jaws 156 and 157 that define a channel therebetween. The jaws 156 and 157 are integrally interconnected to define a leaf spring that accommodates resilient deflection of the jaws 156 and 157 away from one another, and that biases the jaws 156 and 157 toward parallel alignment with one another. The channel is sized and configured to receive a section of the rope 110 therebetween, as further explained below. Staggered ribs or teeth 158*a*, 158*b*, and 159 are provided on inwardly facing sides of respective jaws 156 and 157 to force the clamped segment of the rope 110 to assume a non-linear, generally serpentine route through the clamping portion, as suggested in FIG. 3. As shown in FIGS. 2 and 5, the outermost rib 158*a* is configured and arranged to releasably trap a proximate portion of the rope 110 within the channel of the clamping portion.

Figure 10:
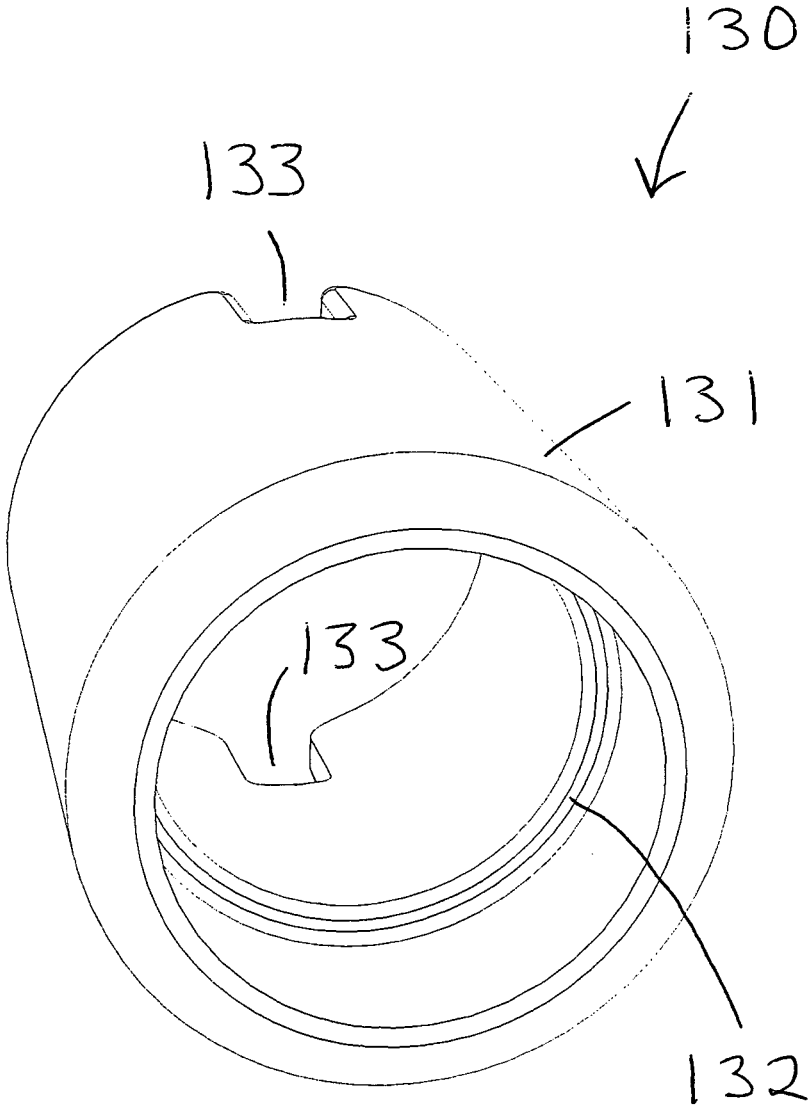
FIG. 10 is a perspective view of a collar on the jump rope of FIG. 1.

FIG. 10 shows one of the collars 130 by itself. Each collar 130 is preferably injection molded plastic, and may be described as a generally cylindrical shell 131 having two discrete internal diameters and a slightly conical or tapered exterior. The larger internal diameter is sufficiently large to accommodate passage of the entire handle tube 120. The two discrete internal diameters cooperate to define an internal annular stop or shoulder 132 that faces toward the larger end of the shell 131. The shoulder 132 cooperates with the shoulder 129 on each tube half 121 and 122 to block passage of the first end 123 of the handle tube 120 through the collar 130. Diametrically opposed notches 133 extend through respective sidewall portions of the shell 131 at the smaller end of the shell 131. The notches 133 are configured and arranged to align axially with the leaf spring tabs 139 when the shoulders 132 and 129 are abutting one another.

Figure 11:
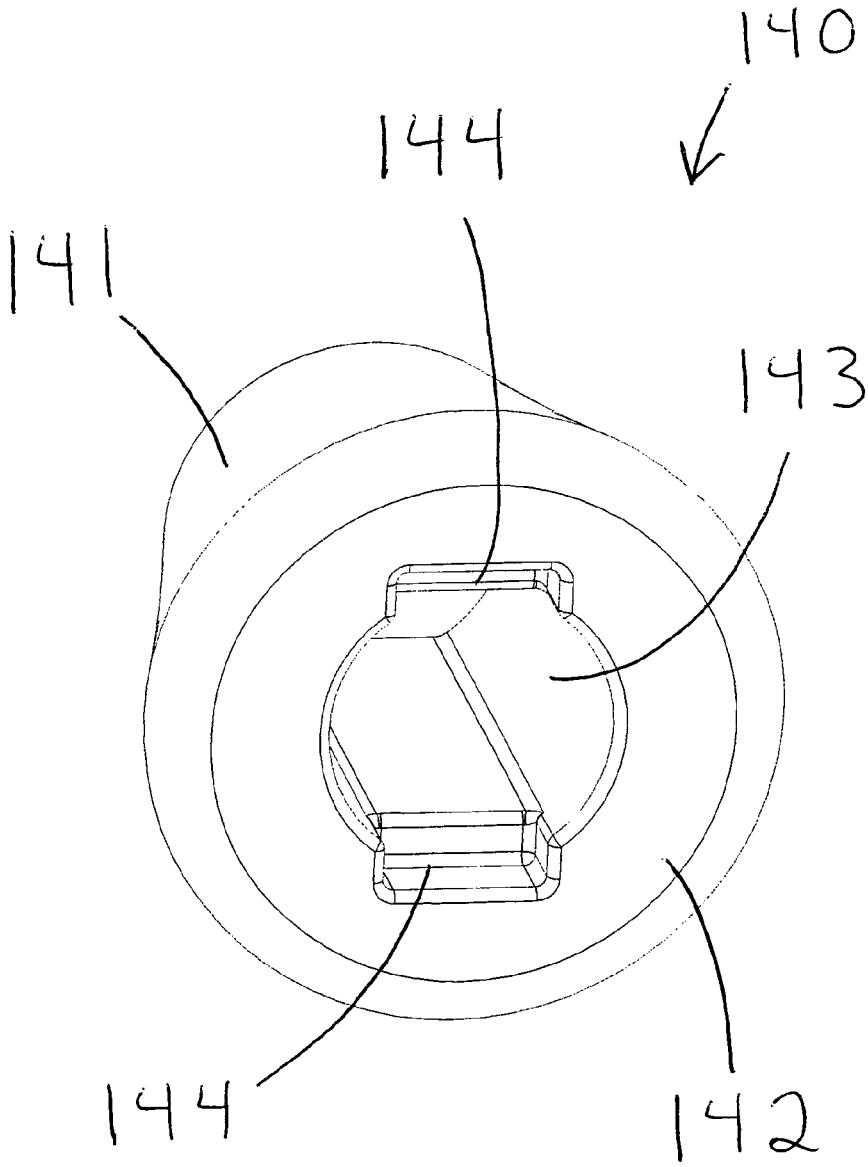
FIG. 11 is a perspective view of an end cap on the jump rope of FIG. 1.

FIG. 11 shows one of the end caps 140 by itself. The end caps 140 also may be described as collars, but are primarily described as end caps for purposes of clarity. Moreover, both the end caps 140 and the collars 130 may be described in the alternative as tubular sleeves. In any event, each end cap 140 is preferably injection molded plastic, and may be described as a generally cylindrical shell 141 having two discrete internal bores 142 and 143 and a slightly conical or tapered exterior. The bore 142 is conical, and the bore 143 is configured to match the perimeter of the second end 124 of the tube halves 121 and 122. In this regard, the bore 143 is bounded by two diametrically opposed arcuate walls and by two diametrically opposed flat walls. Diametrically opposed notches 144 extend into the sidewalls of the bores 142 and 143 at the juncture between the two bores 142 and 143. The notches 144 are configured and arranged to align axially with the leaf spring tabs 148 when the smaller end of the end cap 140 is abutting the shoulders 128 on the tube halves 121 and 122.

The present invention also may be described in terms of methods, including a method of assembling the preferred embodiment jump rope 100, for example. In this regard, the present invention may be described as a method of assembling a rope 110, a first pair of elongate handle members 121 and 122, a second pair of elongate handle members 121 and 122, a first rope clamp 150 and a second rope clamp 150, a first collar 140 and a second collar 140, a first end cap 140, and a second end cap 140 into a jump rope 100. The first handle members 121 and 122 are aligned relative to one another in a manner that defines an elongate tube 120 and rotatably supports the first rope clamp 150 inside a first end of the tube 120. The complementary pegs 107 and holes 108 help to ensure proper alignment of the handle members 121 and 122, and the cavities 105 align to rotatably retain the disc 155 on the rope clamp 150.

The first collar 130 is slid over an opposite, second end of the tube 120, then along the tube 120, and into a locked position at the first end of the tube 120. The leaf springs 137 deflect to accommodate passage of the collar 130 past the tabs 139. The shoulders 129 on the tube halves 121 and 122 engage the shoulder 132 on the collar 130 to stop travel of the collar 130 toward the first end of the tube 120. The collar 130 is then rotated, if necessary, until the tabs 139 on the leaf springs 137 align with the notches 133 in the collar 130 and deflect into the notches 133, thereby discouraging movement of the collar 130 back toward the second end of the tube 120.

The first end cap 140 is slid over the second end of the tube 120 and into a locked position at the second end of the tube 120. The leaf springs 146 deflect to accommodate passage of the end cap 140 past the tabs 148. The shoulders 128 on the tube halves 121 and 122 engage the smaller end of the end cap 140 to stop travel of the end cap 140 onto the second end of the tube 120. The end cap 140 is then rotated, if necessary, until the tabs 148 on the leaf springs 146 align with the notches 144 in the end cap 140 and deflect into the notches 144, thereby discouraging movement of the end cap 140 back off the second end of the tube 120.

The process is repeated for the second handle assembly. In other words, the second handle members 121 and 122 are similarly aligned relative to one another in a manner that defines an elongate second tube 120 and rotatably supports the second rope clamp 150 inside a first end of the second tube 120. The second collar 130 is similarly slid over an opposite, second end of the second tube 120 and into a locked position at the first end of the second tube 120. The second end cap 140 is similarly slid over the second end of the second tube 120 and into a locked position at the first end of the second tube 120.

The preferred method may include the additional steps of subsequent to sliding the first collar 130 onto the first end of the first tube 120, and prior to sliding the first end cap 140 onto the second end of the first tube 120, sliding a first hand grip sleeve 160 over the second end of the first tube 120 and onto an intermediate portion of the first tube 120; and subsequent to sliding the second collar 130 onto the first end of the second tube 120, and prior to sliding the second end cap 140 onto the second end of the second tube 120, sliding a second hand grip sleeve 160 over the second end of the second tube 120 and onto an intermediate portion of the second tube 120.

The preferred method further involves securing a first end of the rope 110 to the first rope clamp 150, and securing an opposite, second end of the rope 110 to the second rope clamp 150. These steps involving the rope 110 are preferably performed after the rope clamps 150 are connected to respective handle tubes 120, but may be performed in advance if so desired. In any event, on the preferred embodiment 100, these steps involve sliding the first end of the rope 110 through the bore 151 in first rope clamp 150 and into a rope cavity defined inside the first tube 120, and sliding the second end of the rope 110 through the bore 151 in the second rope clamp 150 and into a rope cavity defined inside the second tube 150. An advantage of the present invention is that this step may be reiterated in order to adjust how much of the rope 110 is available between the two rope clamps 150. As shown in FIG. 6, each end of the rope 110 is then bent and pushed between the opposing jaws 156 and 157 of a respective rope clamp 150. The bend in the rope 110 and the intermittent ribs 158*a*, 158*b*, and 159 discourage the clamped portion of the rope 110 from moving relative to the rope clamp 150 during use.

Each handle tube 120 is long enough to house a linear segment of the rope 110 that measures approximately nine inches in length. As a result, the effective length of the jump rope 100, as defined between the two rope clamps 150, may be adjusted through a range of approximately eighteen inches. The nature of the rope clamps 150 accommodates such adjustments without tools or hassle. A person simply pries the rope 110 from one or both rope clamps 150, positions a desired amount of the rope 110 inside the handle tube(s) 120, and then wedges the rope 110 back into the rope clamp(s) 150. In other words, a person can assess how much useable rope is extending between the first rope clamp 150 and the second rope clamp 150, and if more useable rope is deemed necessary, pull some of the rope 110 out of at least one handle tube 120, and if less useable rope is deemed necessary, push some of the rope 110 into at least one handle tube 120. This feature of the present invention makes the jump rope 100 particularly well suited for growing children and for use by multiple people (e.g. in a family or an institutional environment). This feature also accommodates quick and easy replacement of an old rope 110 with a new rope 110.

Another advantage of the preferred embodiment jump rope 100 is that the handles can be completely assembled and disassembled without any tools or secondary fasteners. In this regard, the leaf springs 137 and 146 may be depressed to release the collar 130 and the end cap 140, respectively, for removal from the handle tube 120. The hand grip sleeve 160 is preferably removed subsequent to removal of the end cap 140 and prior to removal of the collar 130.

Figure 12:
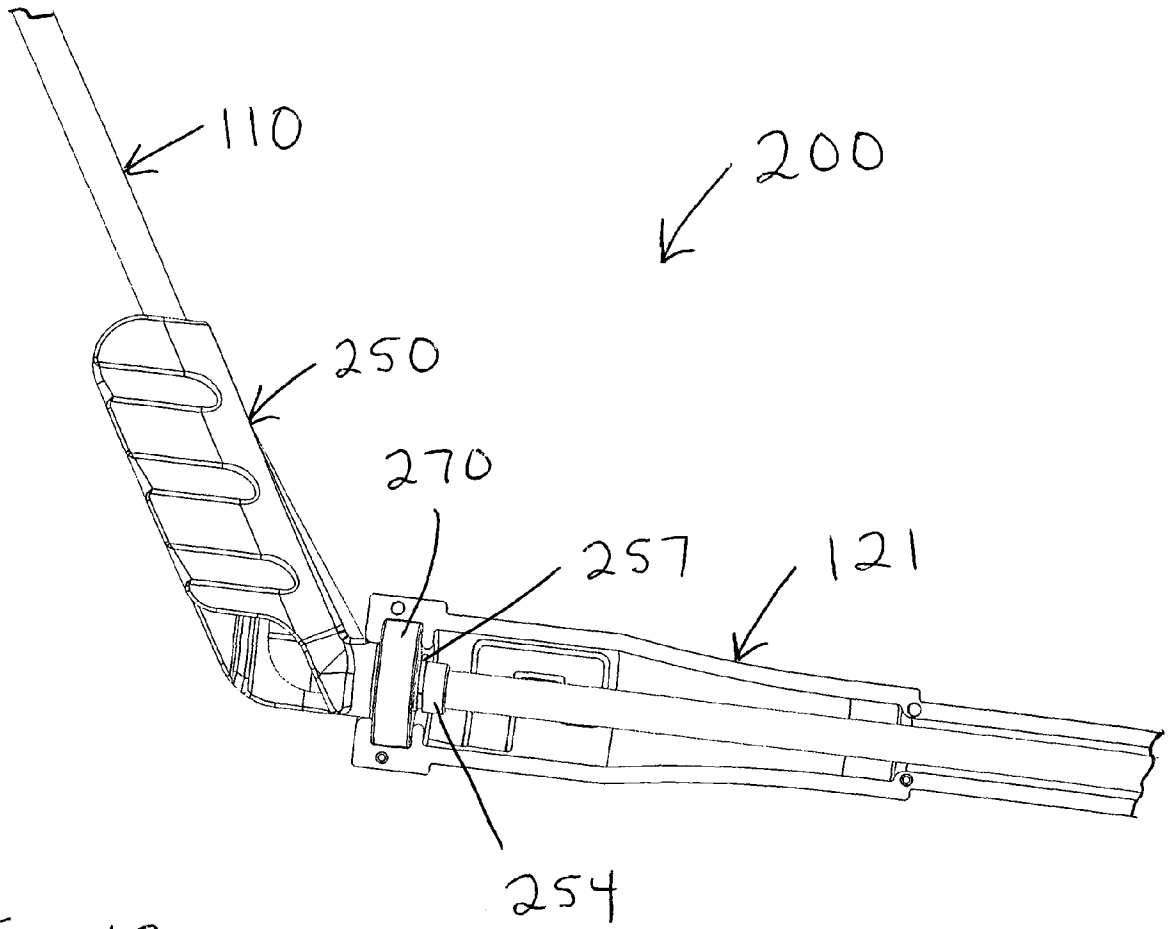
FIG. 12 is a side view of certain components on an alternative embodiment jump rope constructed according to the principles of the present invention.

The present invention has been described with reference to a preferred embodiment. However, the present invention may be implemented on alternative embodiments and in alternative manners. For example, FIG. 12 shows an alternative embodiment jump rope 200 constructed according to the principles of the present invention. The jump rope 200 is similar in many respects to the jump rope 100, and thus, the following description will focus primarily on the differences.

The jump rope 200 similarly has first and second tube halves 121 and 122 that are secured together by a collar 140 and an end cap 130 in the same manner as the preferred embodiment 100. However, a conventional ball bearing pack 270 is retained in the cavities 105, instead of the rope clamp disc 155, and after an alternative embodiment rope clamp 250 is retained relative to the ball bearing pack 270. In this regard, the rope clamp 250 has a clamping portion that is identical to the rope clamp 150, but a rotor portion that is different. In other words, the rotor portion includes a shaft 254 that is devoid of the disc 155, and instead, has shallow circumferential grooves formed in opposite sides of its exterior surface. The shaft 254 is inserted through the ball bearing pack 270, and then a C-ring fastener 257 is pressed into the grooves in the shaft 254 to capture the ball bearing pack 270 between the C-ring fastener 257 and a relatively larger diameter portion of the rope clamp 250. The outside diameter of the shaft 254 is essentially identical to the inside diameter defined by the ball bearing pack 270 to ensure a snug fit. After these initial assembly steps, the ball bearing pack 270 is retained within the cavities 105, and the remaining assembly is identical to that described above with reference to the preferred embodiment 100.

Figure 13:
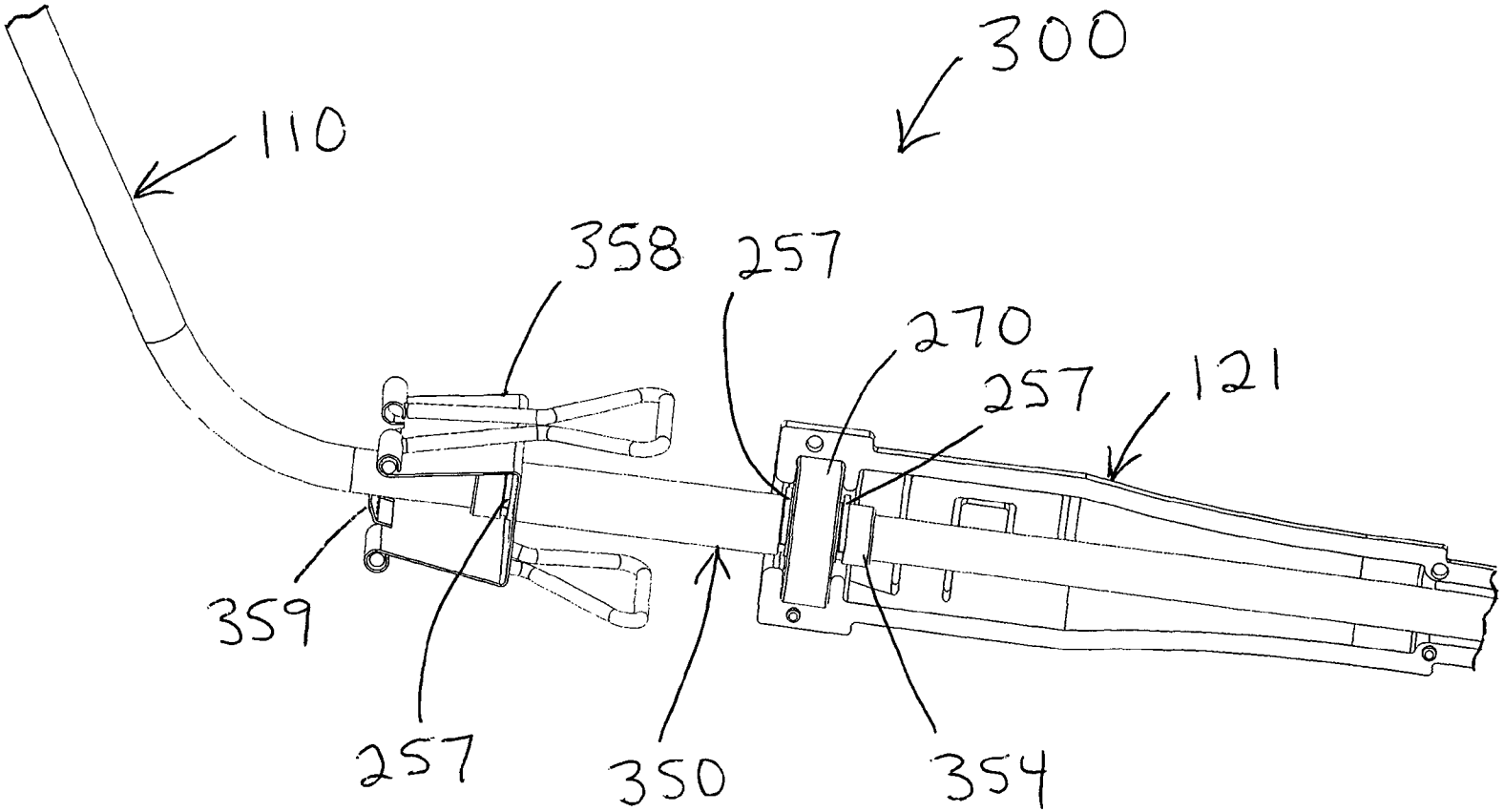
FIG. 13 is a side view of certain components on another alternative embodiment jump rope constructed according to the principles of the present invention.

FIG. 13 shows another alternative embodiment jump rope 300 constructed according to the principles of the present invention. The jump rope 300 is similar in many respects to the jump rope 200, and thus, the following description will focus primarily on the differences. The jump rope 300 similarly has first and second tube halves 121 and 122 that are secured together by a collar 140 and an end cap 130 in the same manner as the preferred embodiment 100, and the same ball bearing pack 270 as the previous embodiment 200. The jump rope 300 has a rope clamp 350 with a shaft 354 that inserts into the ball bearing pack in the same manner as the previous embodiment 200. A first C-ring fastener 257 is secured to the shaft 354 inward of the ball bearing pack 270, and a second C-ring fastener is secured to the shaft 354 outward of the ball bearing pack 270, thereby capturing the ball bearing pack 270 therebetween.

The shaft 354 extends linearly outward from the ball bearing pack 270, and a modified spring clip 358 is mounted on the shaft 354. In this regard, a hole is formed through the central intermediate portion of a conventional spring clip to accommodate passage of the shaft 354. Also, at least one rib or tooth 359 is optionally added to the otherwise conventional spring clip to bite into the rope 110. The shaft 354 is inserted through the hole, and a third C-ring fastener 257 is pressed into grooves in the shaft 354, outboard from the spring clip 358, to retain the spring clip 359 on the shaft 354. A fourth C-ring fastener (not shown) may be secured on a side of the spring clip 358 opposite the third C-ring fastener 257 to sandwich the spring clip 358 therebetween. As on the other embodiments 100 and 200, a coaxially aligned bore extends through the shaft 354 to accommodate passage of the rope 110. The remaining assembly of the jump rope 300 is identical to that described above with reference to the preferred embodiment 100.

To adjust how much of the rope 110 is available between the two spring clips 359, a person simply squeezes the wire-form handles toward one another (when arranged as shown in FIG. 13), and then slides the rope 110 into or out of the handle tube 120. When the wireform handles are released, the spring clips 359 clamp the rope in place relative to the shaft 354. The exposed lengths of the shafts 354 provide relatively more room for storage of "inactive" end segments of the rope 110.

Persons skilled in the art will recognize additional ways to clamp the rope in accordance with the principles of the present invention (e.g. other leaf spring arrangements, alligator clips and other clamps biased by torsion springs, clamps with one stationary jaw and one moving jaw, clamping members associated with an auxiliary fastener that moves in one direction to squeeze and in an opposite direction to release, spring-biased cams that pivot or otherwise move one direction to squeeze and an opposite direction to release), and/or additional ways to assemble the handles (e.g. extruded tubes, blow-molded tubes, bored tubes) in accordance with the principles of the present invention, and further that various rope clamping elements may be combined with various handle structures to create additional alternative embodiments. Recognizing that this disclosure will enable persons skilled in the art to derive various modifications, improvements, and/or applications that nonetheless embody the essence of the invention, the scope of the present invention is to be limited only to the extent of the following claims.

What is claimed is:

1. A jump rope, comprising:

a flexible rope having a first end and an opposite, second end;

a first handle and a second handle, wherein at least one of said handles comprises (a) a tubular body having an exterior sized and configured for grasping in a person's hand, and an interior sized and configured to house a respective end of the rope; (b) a rope clamp having a rotor portion rotatably retained within the interior of the tubular body, and a clamping portion disposed outside the tubular body and rigidly attached to the rotor portion, wherein the clamping portion includes a first jaw, an opposing second jaw, and a resilient member interconnected between the first jaw and the second jaw, wherein the resilient member biases the first jaw and the second jaw to releasably clamp a respective section of the rope therebetween.

2. The jump rope of claim 1, wherein said tubular body comprises first and second elongated members having complementary cross-sections that cooperate to define a generally cylindrical tube; and a collar sized and configured to sleeve snugly into a retained position surrounding a first end of the tube.

3. The jump rope of claim 2, further comprising a tubular hand grip sized and configured to sleeve snugly onto an intermediate portion of the tube.

4. The jump rope of claim 3, further comprising an end cap sized and configured to sleeve snugly into a retained position surrounding an opposite, second end of the tube.

5. The jump rope of claim 1, wherein the first jaw and the second jaw are integral portions of a single part.

6. The jump rope of claim 1, wherein said resilient member includes at least one leaf spring.

7. The jump rope of claim 1, wherein respective, longitudinally staggered rope engaging ridges are disposed on the first jaw and the second jaw in a manner that defines a serpentine rope path between the first jaw and the second jaw.

8. The jump rope of claim 1, wherein said rotor portion includes a cylindrical tube sized and configured for insertion through an annular bearing assembly retained within a cylindrical cavity defined by a respective said tubular body.

9. A jump rope handle for use with a rope, comprising:

a tubular body having an exterior sized and configured for grasping in a person's hand, and an interior sized and configured to house an end of a rope; and a rope clamp having a rotor portion rotatably retained within the interior of the tubular body, and a clamping portion disposed outside the tubular body, and attached to the rotor portion wherein the clamping portion has opposing resiliently biased first and second jaws with longitudinally staggered ridges configured and arranged to releasably clamp against respective first and second sides of a section of the rope and thereby impose a serpentine effect on said section of the rope.

10. The jump rope handle of claim 9, wherein the tubular body includes two elongated members having generally C-shaped cross-sections and aligned with one another to define a generally cylindrical tube, and a collar sleeved about one end of the tube, and an end cap sleeved about an opposite end of the tube.

11. A jump rope handle, comprising:

first and second elongate handle members aligned with one another to define an elongate tube having a first end and an opposite, second end, wherein at least one of the handle members has a sidewall configured to define at least one radially projecting leaf spring; a rope clamp rotatably connected to the tube, wherein the rope clamp has opposing first and second rope clamping jaws and a spring interconnected between the first and second rope clamping jaws;

a tubular collar secured about the first end of the tube in a manner that holds the handle members together; and a tubular end cap secured about the second end of the tube in a manner that holds the handle members together, wherein at least one of the end cap and the collar is resiliently retained in place on a respective said end by said at least one radially projecting leaf spring.

12. The jump rope of claim 11, further comprising a ball bearing pack interconnected between the tube and the rope clamp, wherein the ball bearing pack is disposed in the first end of the tube, and the collar is configured to slide onto the second end of the tube and into place on the first end of the tube.

13. The jump rope of claim 11, further comprising a tubular hand grip configured to slide onto the second end of the tube and into place on an intermediate portion of the tube.

14. The jump rope of claim 11, wherein the collar bypasses a first said radially projecting leaf spring proximate the second end of the tube, and resiliently snaps into and out of engagement with a second said radially projecting leaf spring proximate the first end of the tube, and the end cap resiliently snaps into and out of engagement with the first said radially projecting leaf spring proximate the second end of the tube.

15. A jump rope handle for use with a rope, comprising:

a hand grip member sized and configured for grasping in a person's hand;

a cylindrical tube rotatably mounted on the hand grip member, wherein the tube has an internal end and an external end; and a U-shaped member having a proximal end and a distal end, wherein the proximal end is rigidly connected to the external end, wherein the U-shaped member has opposing and resiliently interconnected first and second sidewalls that cooperate to define a longitudinally extending groove therebetween.

16. The jump rope handle of claim 15, further comprising at least one ridge on a first one of the first and the second sidewalls which projects into the groove.

17. The jump rope handle of claim 16, wherein at least one ridge on a second one of the first and the second sidewalls which the second sidewall projects into the groove at a longitudinally spaced location relative to the at least one ridge on the first one of the first and the second sidewalls.

* * * * *